US007325616B2

(12) United States Patent
Lopez de Cardenas et al.

(10) Patent No.: US 7,325,616 B2
(45) Date of Patent: Feb. 5, 2008

(54) SYSTEM AND METHOD FOR COMPLETING MULTIPLE WELL INTERVALS

(75) Inventors: Jorge Lopez de Cardenas, Sugar Land, TX (US); Gary Rytlewski, League City, TX (US); Patrick Mukoro, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 307 days.

(21) Appl. No.: 10/907,509

(22) Filed: Apr. 4, 2005

(65) Prior Publication Data

US 2006/0124311 A1 Jun. 15, 2006

Related U.S. Application Data

(63) Continuation-in-part of application No. 10/905,073, filed on Dec. 14, 2004.

(51) Int. Cl.
*E21B 43/32* (2006.01)

(52) U.S. Cl. ..... 166/313; 166/285; 166/386

(58) Field of Classification Search ..... 166/308.1, 166/386, 373, 298, 55, 321, 177.5, 313, 332.8, 166/332.4

See application file for complete search history.

(56) References Cited

U.S. PATENT DOCUMENTS 4,444,266 A * 4/1984 Pringle ..... 166/324
4,813,481 A * 3/1989 Sproul et al. ..... 166/51
4,949,788 A * 8/1990 Szarka et al. ..... 166/285
5,224,556 A 7/1993 Wilson et al.
5,660,232 A 8/1997 Reinhardt
5,848,646 A * 12/1998 Huber et al. ..... 166/297
6,009,947 A 1/2000 Wilson et al.
6,386,288 B1 5/2002 Snider et al.
6,951,331 B2 * 10/2005 Haughom et al. ..... 251/180
2002/0007949 A1 * 1/2002 Tolman et al. ..... 166/280
2003/0070811 A1 4/2003 Robison et al.
2003/0136562 A1 7/2003 Robison et al.
2003/0234104 A1 * 12/2003 Johnston et al. ..... 166/298
2004/0084189 A1 * 5/2004 Hosie et al. ..... 166/386
2005/0230118 A1 * 10/2005 Noske et al. ..... 166/332.8
2006/0124315 A1 * 6/2006 Frazier et al. ..... 166/369
2006/0157255 A1 * 7/2006 Smith ..... 166/374

OTHER PUBLICATIONS

McDaniel, B.W., "Review of Current Fracture Stimulation Techniques for Best Economics in Multilayer, Lower-Permeability Reservoirs," SPE paper, Sep. 2005, pp. 1-19, SPE 98025, SPE Eastern Regional Meeting, Morgantown, West Virginia.

Thomson, D.W. and Nazroo, M.F.; "Design and Installation of a Cost-Effective Completion System for Horizontal Chalk Wells Where Multiple Zones Require Acid Stimulation"; Offshore Technology Conference, May 1997, Houston, Texas; SPE 51177 (a revision of SPE 39150).

* cited by examiner

*Primary Examiner*—Frank Tsay
(74) *Attorney, Agent, or Firm*—Winstead PC; Dona C. Edwards; Bryan P. Galloway

(57) ABSTRACT

A system and method for completing a well with multiple zones of production includes a casing having a plurality of flapper valves integrated therein for isolating each well zone and a perforating gun string for selectively perforating the casing and underlying formation at each well zone to establish communication between the formation and the interior of the casing and to facilitate delivery of treatment fluid to each of the multiple well zones. The system and method may include mechanisms for selectively actuating each flapper valve, such as by detonating a perforating gun in a perforating gun string. The system and method may include providing a perforating gun string having multiple guns, each gun selectively detonated at a corresponding well zone, and the gun string being stored in a lubricator at the surface between alternating sequences of perforating and treating the well zones.

17 Claims, 11 Drawing Sheets

SYSTEM AND METHOD FOR COMPLETING MULTIPLE WELL INTERVALS

CROSS-REFERENCE TO RELATED APPLICATIONS

This is a continuation-in-part of U.S. Ser. No. 10/905,073, filed Dec. 14, 2004, entitled "SYSTEM FOR COMPLETING MULTIPLE WELL INTERVALS."

BACKGROUND OF THE INVENTION

1. Field of the Invention

The present invention relates generally to recovery of hydrocarbons in subterranean formations, and more particularly to a system and method for delivering treatment fluids to wells having multiple production zones.

2. Background of the Invention

In typical wellbore operations, various treatment fluids may be pumped into the well and eventually into the formation to restore or enhance the productivity of the well. For example, a reactive or non-reactive "fracturing fluid" or a "frac fluid" may be pumped into the wellbore to initiate and propagate fractures in the formation thus providing flow channels to facilitate movement of the hydrocarbons to the wellbore so that the hydrocarbons may be pumped from the well. In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e., oil, gas or water) into the wellbore. In another example, a reactive stimulation fluid or "acid" may be injected into the formation. Acidizing treatment of the formation results in dissolving materials in the pore spaces of the formation to enhance production flow.

Currently, in wells with multiple production zones, it may be necessary to treat various formations in a multi-staged operation requiring many trips downhole. Each trip generally consists of isolating a single production zone and then delivering the treatment fluid to the isolated zone. Since several trips downhole are required to isolate and treat each zone, the complete operation may be very time consuming and expensive.

Accordingly, there exists a need for systems and methods to deliver treatment fluids to multiple zones of a well in a single trip downhole.

SUMMARY

The present invention relates to a system and method for delivering a treatment fluid to a well having multiple well zones (e.g., production zones). According to some embodiments of the present invention, a well completion system is provided having: (1) a casing installed in a wellbore such that the casing intersects one or more well zones, (2) a perforated interval formed at each well zone to establish hydraulic communication with the underlying formation at each particular well zone for delivery of a treatment fluid or for receiving a production fluid, and (3) a flapper valve installed in the wellbore at each well zone above the perforated interval to provide zonal isolation between the various well zones.

Another embodiment of the well completion system of the present invention includes a mechanism for selectively actuating the flapper valves. For example, one such mechanism may be a perforating gun, which actuates a selected flapper valve upon detonation.

Still another embodiment of the well completion system of the present invention includes a perforating gun string including multiple perforating guns that may be fired selectively in each zone of a multi-zonal well. This embodiment also includes a lubricator for storing the gun string at the surface while each well zone is treated.

Other or alternative embodiments of the present invention will be apparent from the following description, from the drawings, and from the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. Moreover, the term "treatment fluid" includes any fluid delivered to a formation to stimulate production including, but not limited to, fracing fluid, acid, gel, foam or other stimulating fluid.

Generally, this invention relates to a system and method for completing multi-zone wells by delivering a treatment fluid to achieve productivity. Typically, such wells are completed in stages that result in very long completion times (e.g., on the order of four to six weeks). The present invention may reduce such completion time (e.g., to a few days) by facilitating multiple operations, previously done one trip at a time, in a single trip.

Figure 1:
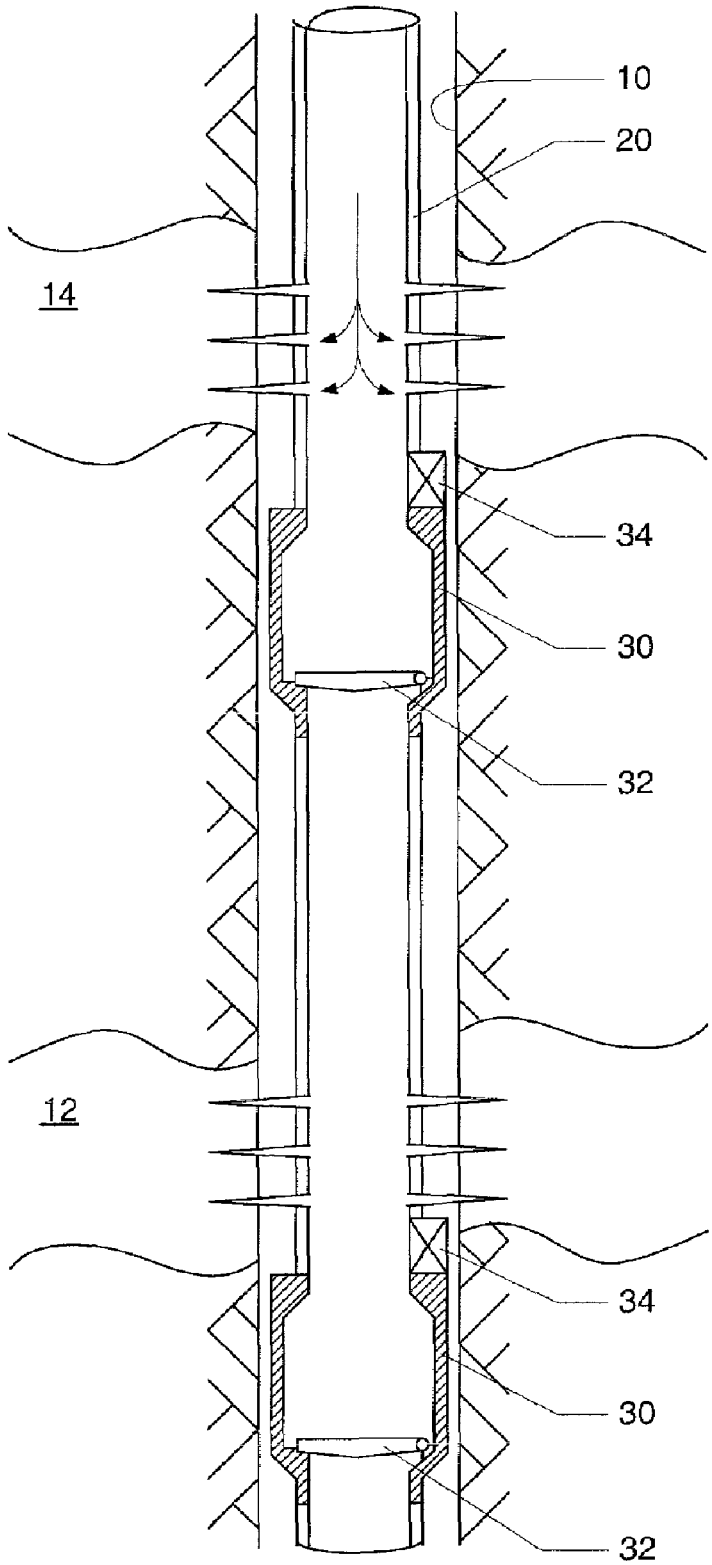
FIG. 1 illustrates a profile view of an embodiment of the multi-zonal well completion system of the present invention having zonal isolation flapper valves installed in a wellbore.

FIG. 1 illustrates an embodiment of the well completion system of the present invention for use in a wellbore 10. The wellbore 10 may include a plurality of well zones (e.g., formation, production, injection, hydrocarbon, oil, gas, or water zones or intervals) 12, 14. The completion system includes a casing 20 having one or more zonal isolation valves 30 integrated or connected inline with the casing and arranged to correspond with each formation zone 12, 14. Each zonal isolation valve 25 is arranged at or just below the corresponding well zone 12, 14 and includes a flapper 32 and a flapper-actuating mechanism 34. However, exact depth positioning of the flapper 32 of each zonal isolation valve 30 is not critical, as long a flapper is arranged somewhere in between each well zone to be treated. The flapper 32 may be any structure that is moveable between an open position whereby communication is established through the axial bore of the casing 20 and a closed position whereby communication is interrupted through the axial bore of the casing. The zonal isolation valves 30 function to regulate hydraulic communication through the axial bore of the casing 20 and thus to isolate a particular well zone from other well zones. For example, to deliver a treatment fluid to the formation at well zone 14, the flapper 32 of the isolation valve 30 shown just bellow well zone 14 must be closed. To close the flapper 32, the flapper-actuating mechanism 34 is activated to move the flapper into the closed position and seal the axial bore of the casing 20. Therefore, any treatment fluid injected into the axial bore of the casing 20 from the surface will be delivered to well zone 14 and blocked from communicating with well zone 12. The flapper-actuating mechanism 34 may be a control line from the surface or a tool controlled from the surface (e.g., a perforating gun). Alternatively, the flapper-actuating mechanism 34 may be controlled remotely as by pressure pulse, electromagnetic radiation waves, seismic waves, acoustic signals, radio frequency, or other wireless signaling. Moreover, while the present invention is described with respect to flapper valves, it is intended that any type of valve or combination of valves may be used to regulate communication through the axial bore of the casing including, but not limited to a flapper valve or a ball valve.

Figure 2:
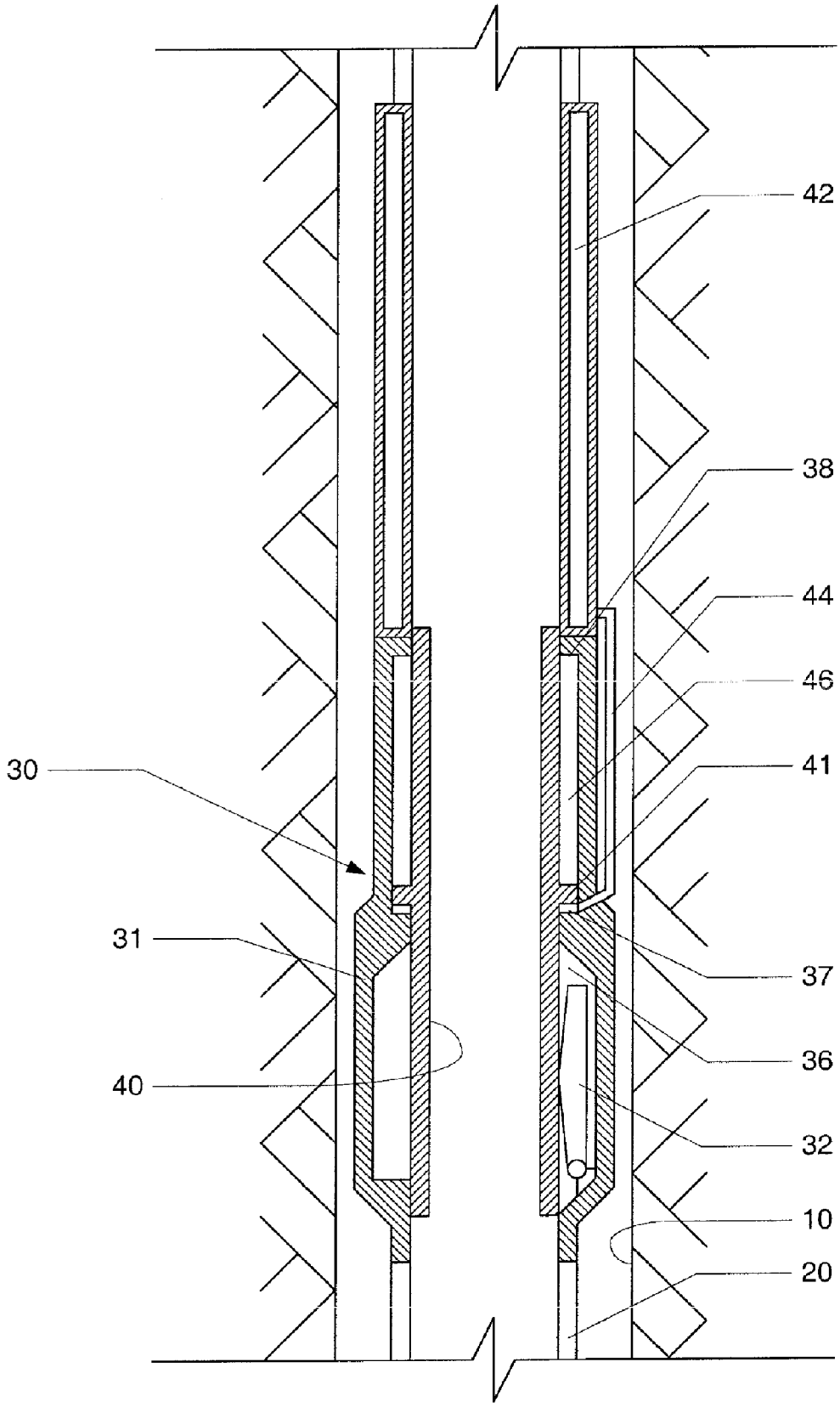
FIG. 2 illustrates an enlarged cross-sectional view of an embodiment of the zonal isolation flapper valve of the present invention.

FIG. 2 illustrates an embodiment of a zonal isolation valve 30. In this embodiment, the valve 30 includes a valve housing 31 having an axial bore therethrough and which is connected to or integrally formed with a casing 20 (or other cemented-in tubular string). The housing 31 has a recess 36 defined therein for containing a flapper 32. The flapper 32 may be energized by any energy supplying device including, but not limited to, a coil spring, a linear spring, compressed gas spring, solenoid, gravity-actuated, mechanically actuated by a collet, fluid flow or hydraulic pressure. A sleeve 40 resides within the axial bore of the valve housing 31 adjacent the recess 36 to hold the flapper 32 in an energized state when the valve 30 is in the open position. The zonal isolation valve 30 further includes a mechanism for actuating the flapper 32 by shifting the sleeve 40 upward, thus allowing the flapper 32 to rotate such that the valve is in the closed position. In some embodiments, a spring (or other energizing device) is provided to energize the flapper. The sleeve 40 includes a piston ring 41 (or other piston element such as a tab or a protruding surface), which rests on or above a lower shoulder 37 formed on the inner bore of the valve housing 31. The shoulder 37 prevents the sleeve 40 from moving axially downward. An upper shoulder 38 may also be formed on the inner bore of the valve housing 31 to provide an upper stop for the piston ring 41 of the sleeve 40. An annular space 46 is defined between the valve housing 31 and the sleeve 40 for the piston ring 41 to traverse. A chamber 42 is arranged above the valve housing 31 and is hydraulically connected to the annular space 46 below the piston ring 41 via a hydraulic conduit 44. In some embodiments, the chamber 42 is an annular chamber having an axial bore sized to receive a perforating gun string. The pressure within the annular space 46 above the piston ring 41 should be less than the well pressure, but greater than the pressure within the chamber 42. Therefore, the pressure differential between the annular space 46 and the chamber 42 forces the sleeve axially downward and thus maintains the valve 30 in the closed position when the chamber is intact. In other embodiments, chambers 42 and 46 are set at a pressure of 0 psi or atmospheric pressure and the sleeve 40 may be held by a shear pin, rupture disk, or other frangible connection to hold the sleeve in place over the flapper 32. To move the zonal isolation valve 30 from the open position to the closed position, the chamber 42 is ruptured (e.g., as by detonating a shaped charge of a perforating gun) to establish communication between the wellbore 10 and the annular space 46 below the piston ring 41 via the hydraulic conduit 44. Once ruptured, well fluid flows from the wellbore 10 through the chamber 42 and into the annular space 46 below the piston ring 41 via the hydraulic conduit 44 to move the sleeve 40 axially upward. As the sleeve 40 clears the flapper 32 in the recess 36 of the valve housing 31, the energized flapper 32 is rotates to seal the axial bore of the casing 20 and move the zonal isolation valve 30 into the closed position.

Figure 3:
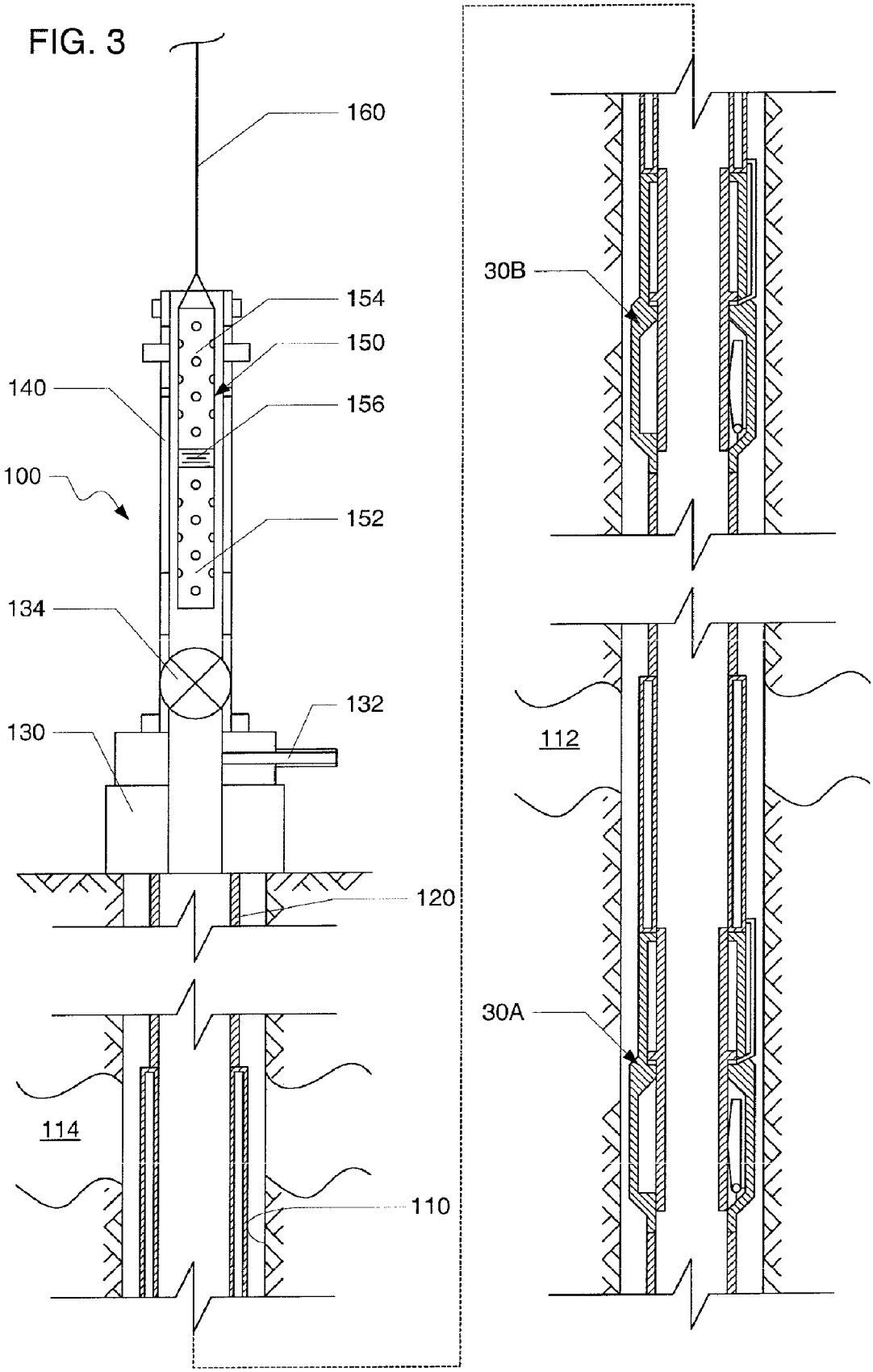
FIGS. 3-11 illustrate a profile view of an embodiment of the method of the present invention for using the zonal isolation flapper valve system and a perforating gun string to perforate and frac a multi-zonal well.

FIG. 3 illustrates an embodiment of the well completion system 100 of the present invention for selectively perforating and delivering a treatment fluid to a well zone in a multi-zonal well. This well completion system 100 includes a wellbore 110 intersecting multiple well zones 112, 114. The well is supported by a casing 120, which is cemented in-place and suspended from a wellhead 130. The wellhead 130 may include: (1) an inlet conduit 132 (or multiple inlets) for injecting a treatment fluid into the wellbore 110, a lubricator 140 (or other tubular member inline with the casing and connected above the wellhead) for receiving a perforating gun string 150, and an inline valve 134 for selectively sealing the wellbore 110 during injection of treatment fluid. The inlet conduit 132 is connected to a treatment fluid supply and pump (not shown) for injection of treatment fluid into the wellbore to treat isolated well zones. The perforating gun string 150 may include a plurality of guns 152, 154 each holding one or more explosive charges and connected together by an adapter 156. The perforating gun string 150 may be suspended and run into the wellbore 110 by a line 160. The line 160 may be any structure capable of supporting and transporting the perforating gun string 150 in and out of the wellbore 110 including, but not limited to, wireline, slickline, or coiled tubing. It is intended that by using wireline or slickline, depth positioning of the perforating gun string 150 may be performed with increased accuracy over prior art completion systems (e.g., casing conveyed perforating gun systems). In other embodiments, the perforating gun may be formed integral with a pumpable dart to be deployed downhole and actuated by a wireless signal as shown in U.S. Ser. No. 10/905,372, which is incorporate herein by reference. The well completion system further includes one or more zonal isolation valves 30A, 30B for isolating and treating well zones 112 and 114 respectively. Each zonal isolation valve 30A, 30B is as described in detail above and illustrated in FIG. 2. However, it is intended that other types of valves or combinations of valves may be used to isolate particular well zones.

Figure 4:
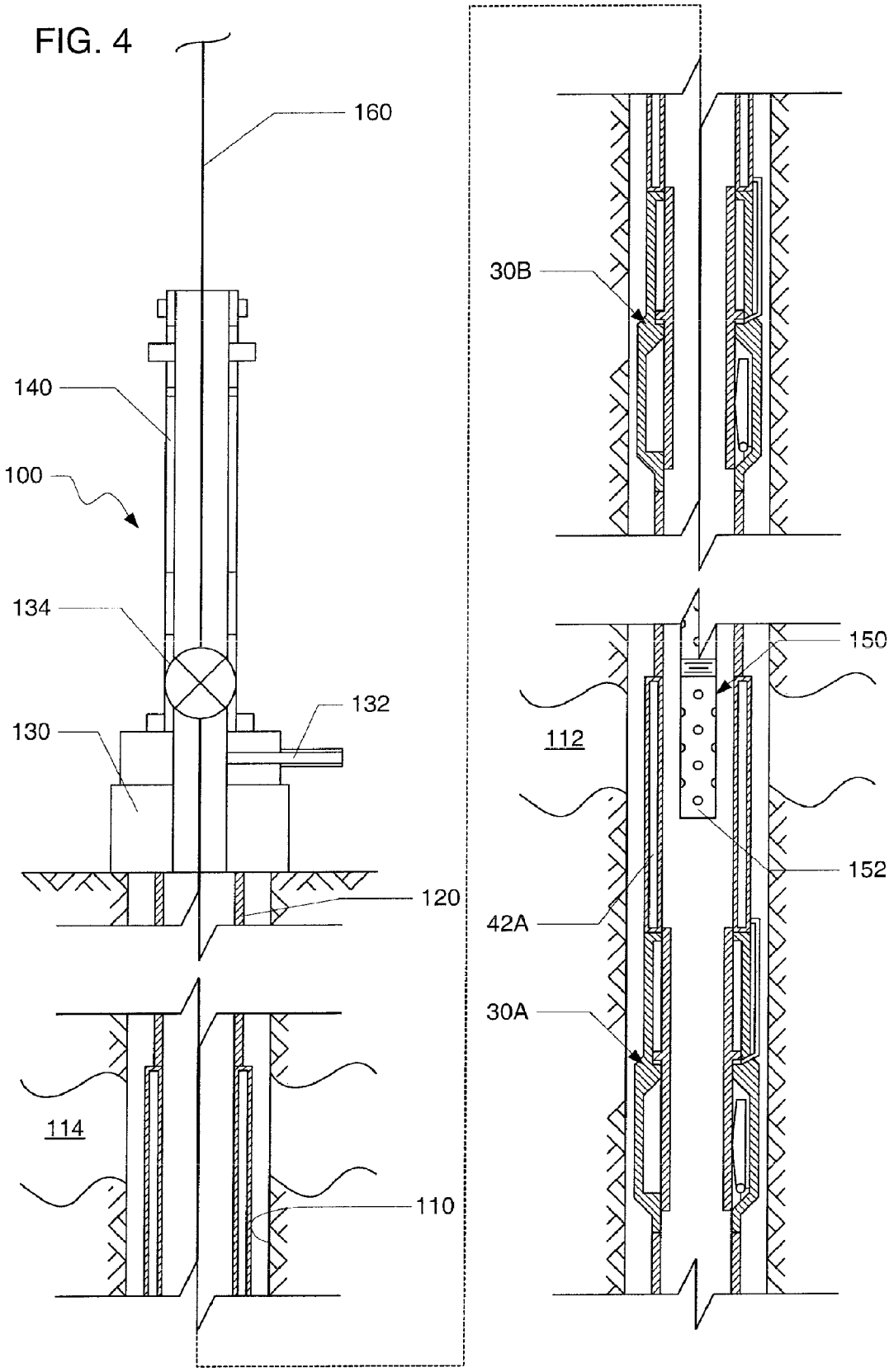

In operating the well completion system 100, with respect to FIG. 4, the inline valve 134 of the wellhead 130 is opened such that the perforating gun string 150 may be lowered into the well. In order to treat the well zone 112 underlying the casing 120, the perforating gun string 150 is first suspended by the line 160 and lowered to the target depth, which corresponds with the chamber 42A of valve 30A via the wellhead 130.

Figure 5:
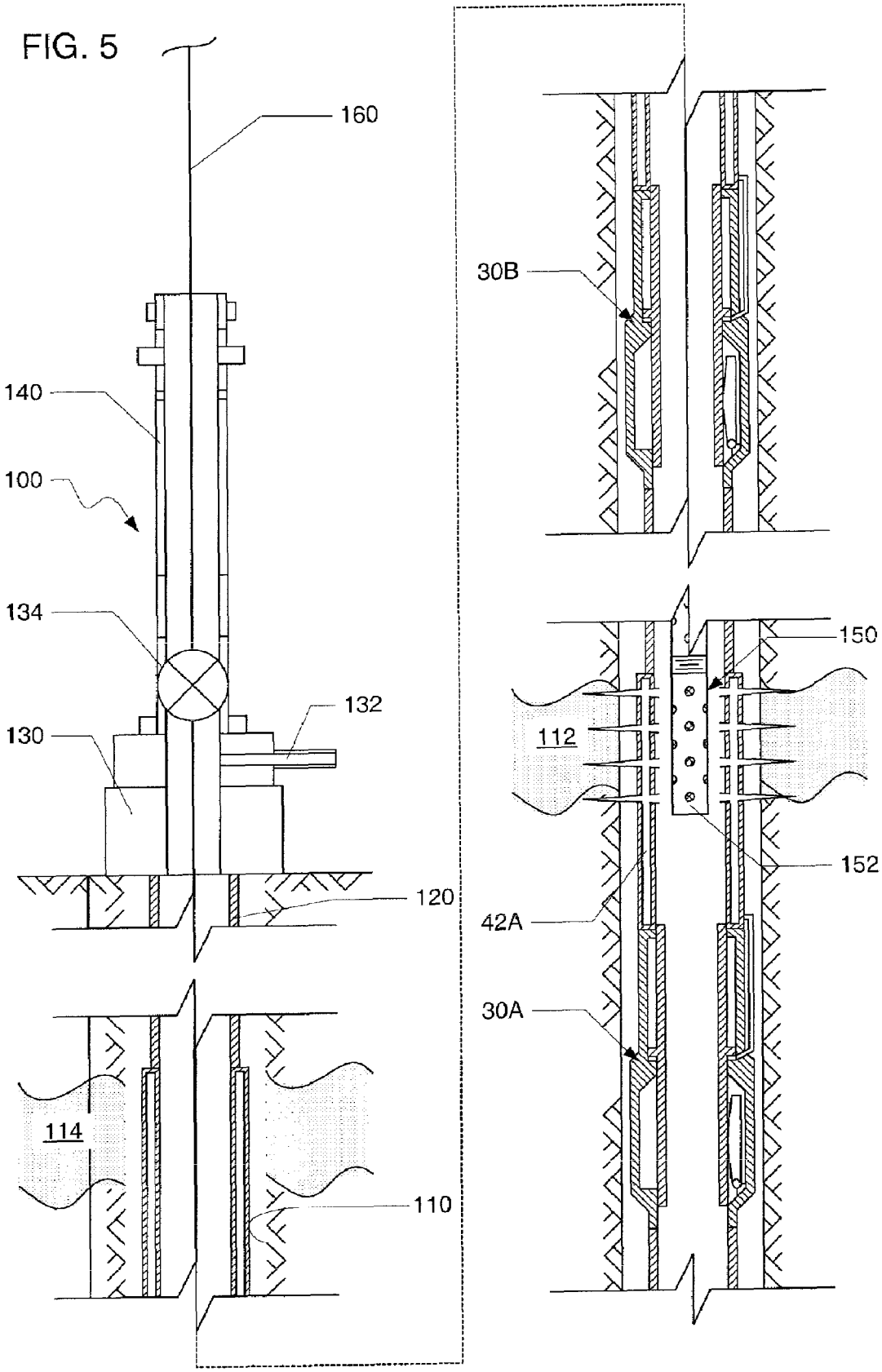

With respect to FIG. 5, once the perforating gun string 150 is lowered to the target depth at well zone 112 such that the lower-most gun 152 is adjacent the chamber 42A of valve 30A, the gun is detonated. The explosive charges of the lower gun 152 ignite and penetrate the surrounding formation at well zone 112 and simultaneously rupture the chamber 42A. In some embodiments, the perforating gun string 150 may be oriented, centralized, and positioned in the wellbore 110 as desired before ignition to create more uniform size penetrations. With more uniform sized penetrations, the treatment fluid subsequently delivered may be more equally distributed around the casing 120.

Figure 6:
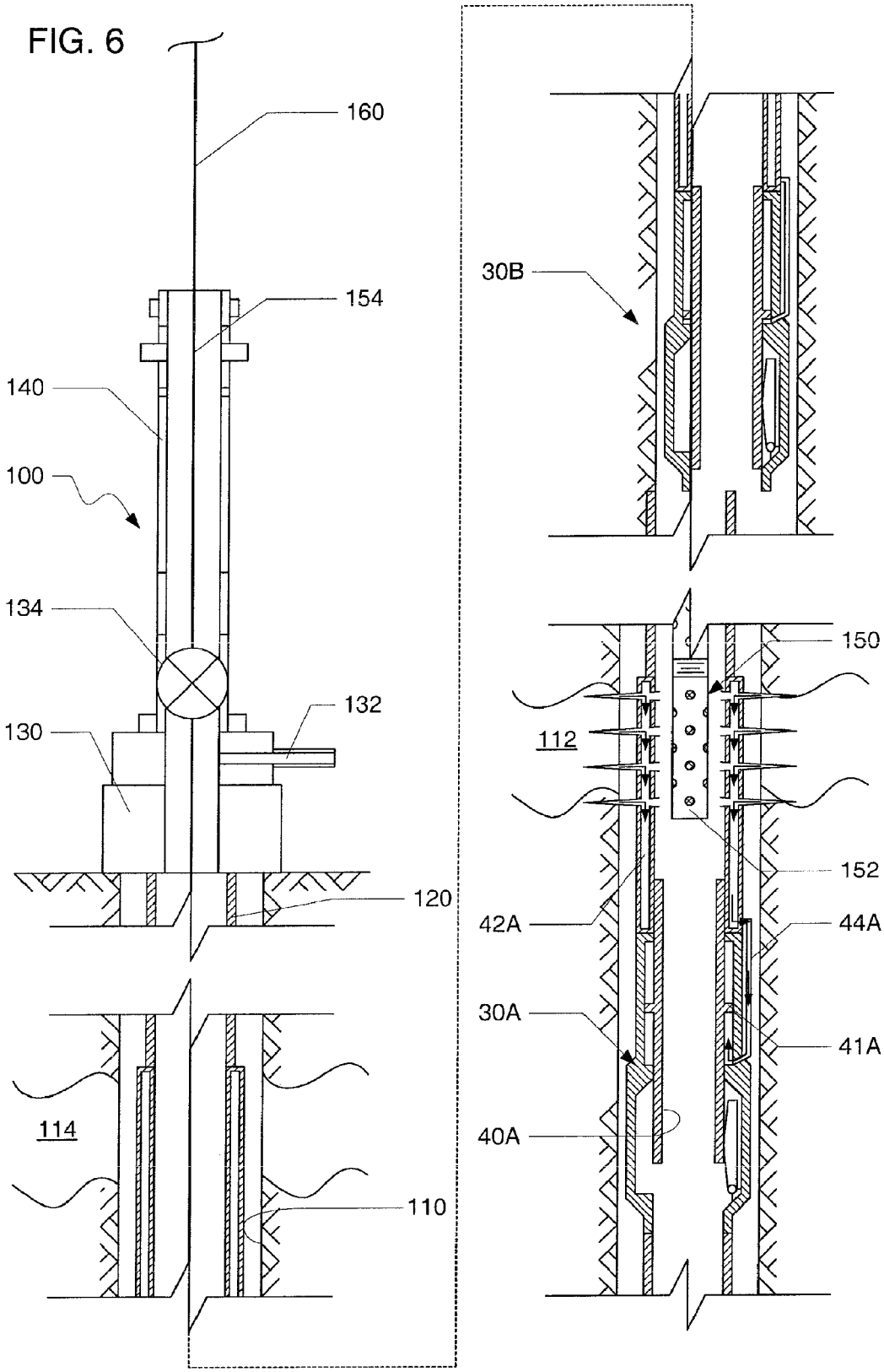

With respect to FIG. 6, with the chamber 42A ruptured, well fluid from the surrounding formation well zone 112 enters the chamber 42A and acts against the piston ring 41A via the hydraulic conduit 44A to move the sleeve 40A axially upward.

Figure 7:
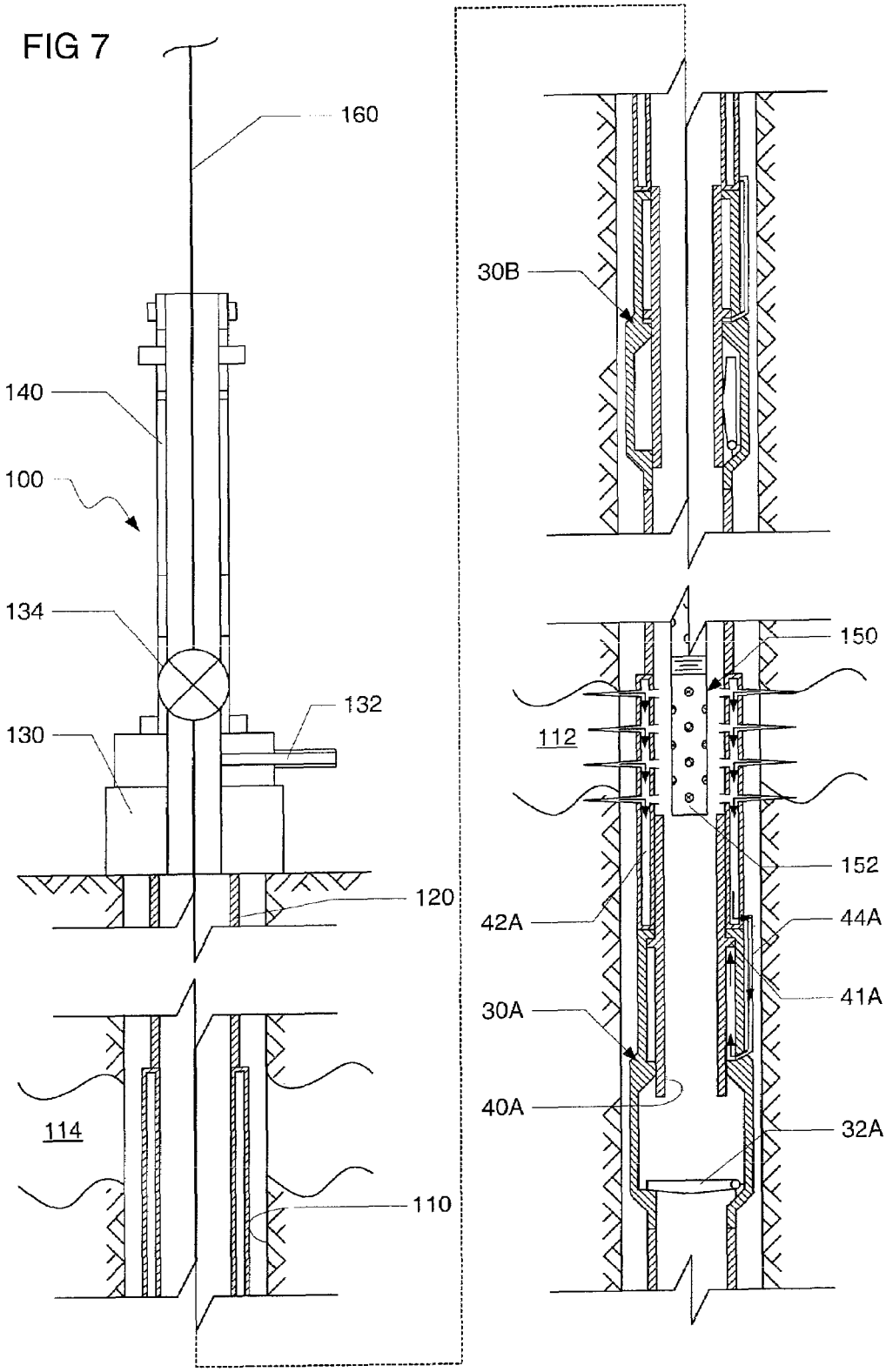

With respect to FIG. 7, once the sleeve 40A has been shifted upward a sufficient distance, the energized flapper 32A rotates to seal the axial bore of the casing 120. At this point, the well zone 112 is isolated from any other well zones below the valve 30A.

Figure 8:
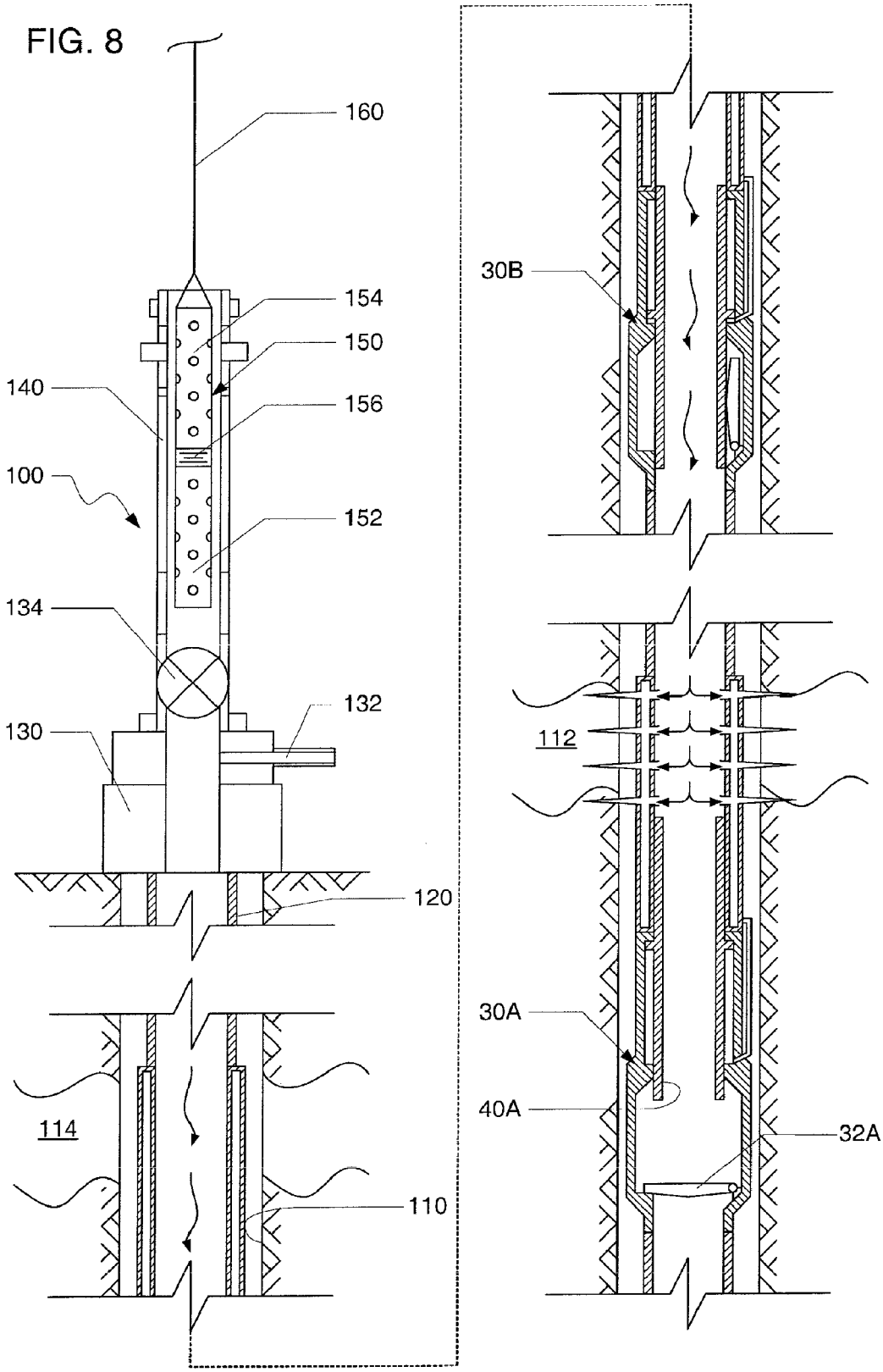

With respect to FIG. 8, once the well zone 112 is isolated, the perforating gun string 150 is pulled from the wellbore 110. A treatment fluid may then be injected into the perforated well zone 112 via the inlet conduit 132. In some embodiments, the gun string 150 may remain in the lubricator 140, which is sealed off from the wellbore 110 by the inline valve 134, instead of being removed from the completion system 100 all together. Each of the guns in the gun string are selectively detonated a each corresponding well zone. In such embodiments, significant operating time and cost saving may be achieved and more individual formation layers may be treated offering increased productivity.

Figure 9:
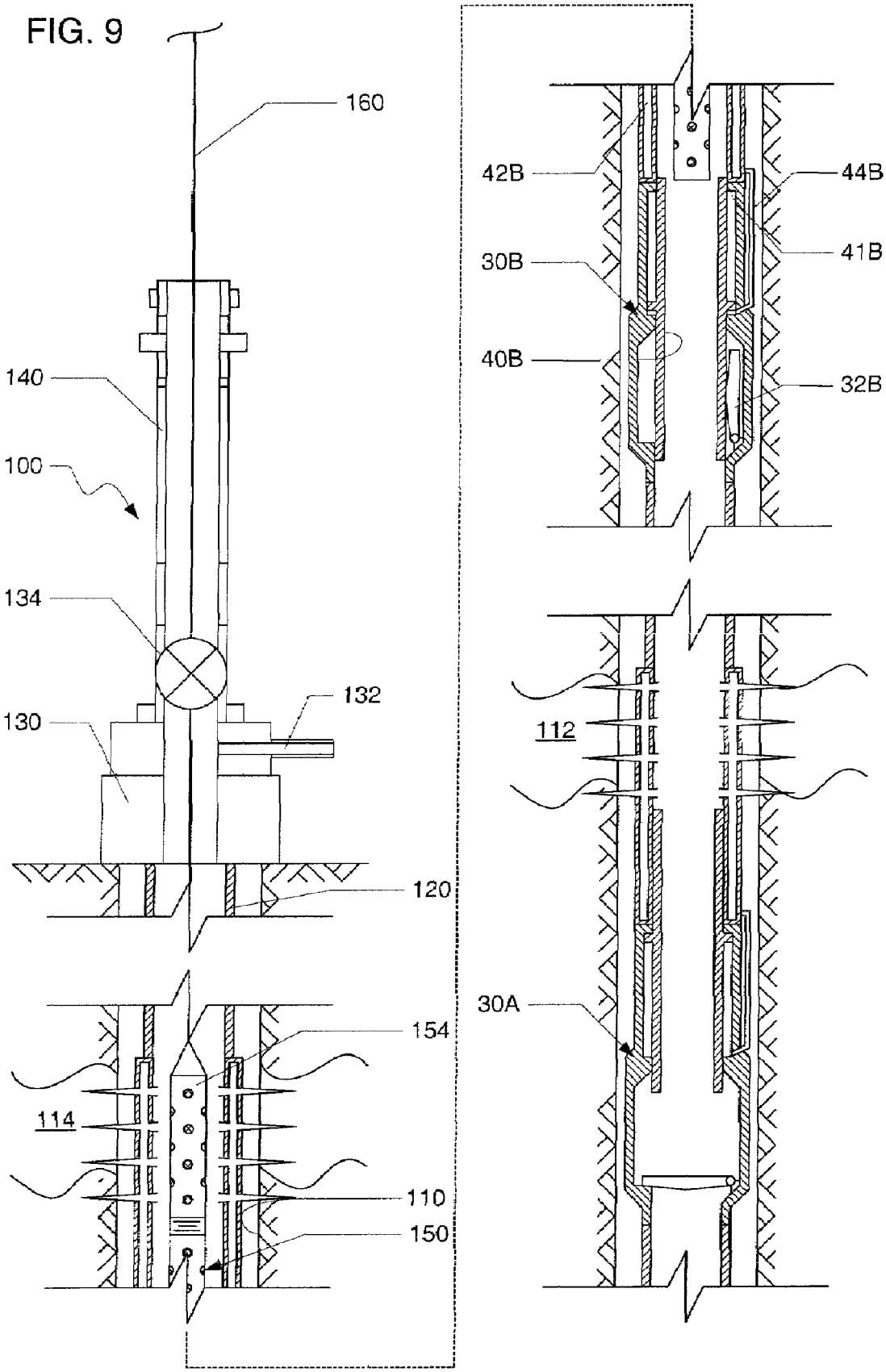

With respect to FIG. 9, after treatment of well zone 112 is completed, it may be desirable to treat an upper well zone 114. In this event, inline valve 134 of wellhead 130 is opened and the perforating gun string 150 is lowered to the target depth such that the lower-most gun 154 is adjacent the chamber 42B of valve 30B. In this position, the gun 154 is detonated. The explosive charges of the upper gun 154 ignite and penetrate the surrounding formation at well zone 114 and simultaneously rupture the chamber 42B.

Figure 10:
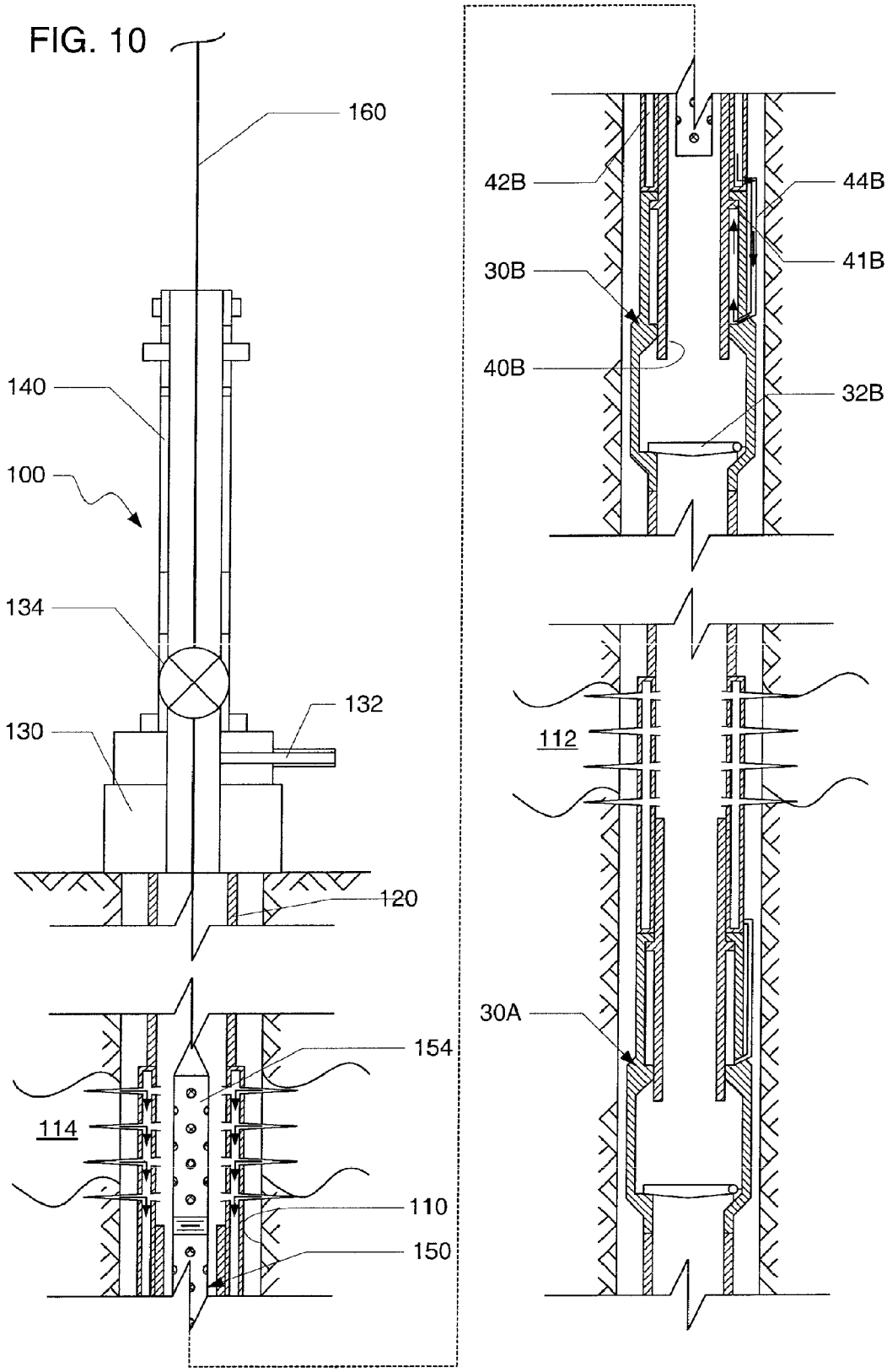

With respect to FIG. 10, with the chamber 42B ruptured, well fluid from the surrounding formation well zone 114 enters the chamber 42B and acts against the piston ring 41B via the hydraulic conduit 44B to move the sleeve 40B axially upward. Once the sleeve 40B has been shifted upward a sufficient distance, the energized flapper 32B rotates to seal the axial bore of the casing 120. At this point, the well zone 114 is isolated from well zone 112 and any other well zones below the valve 30B.

Figure 11:
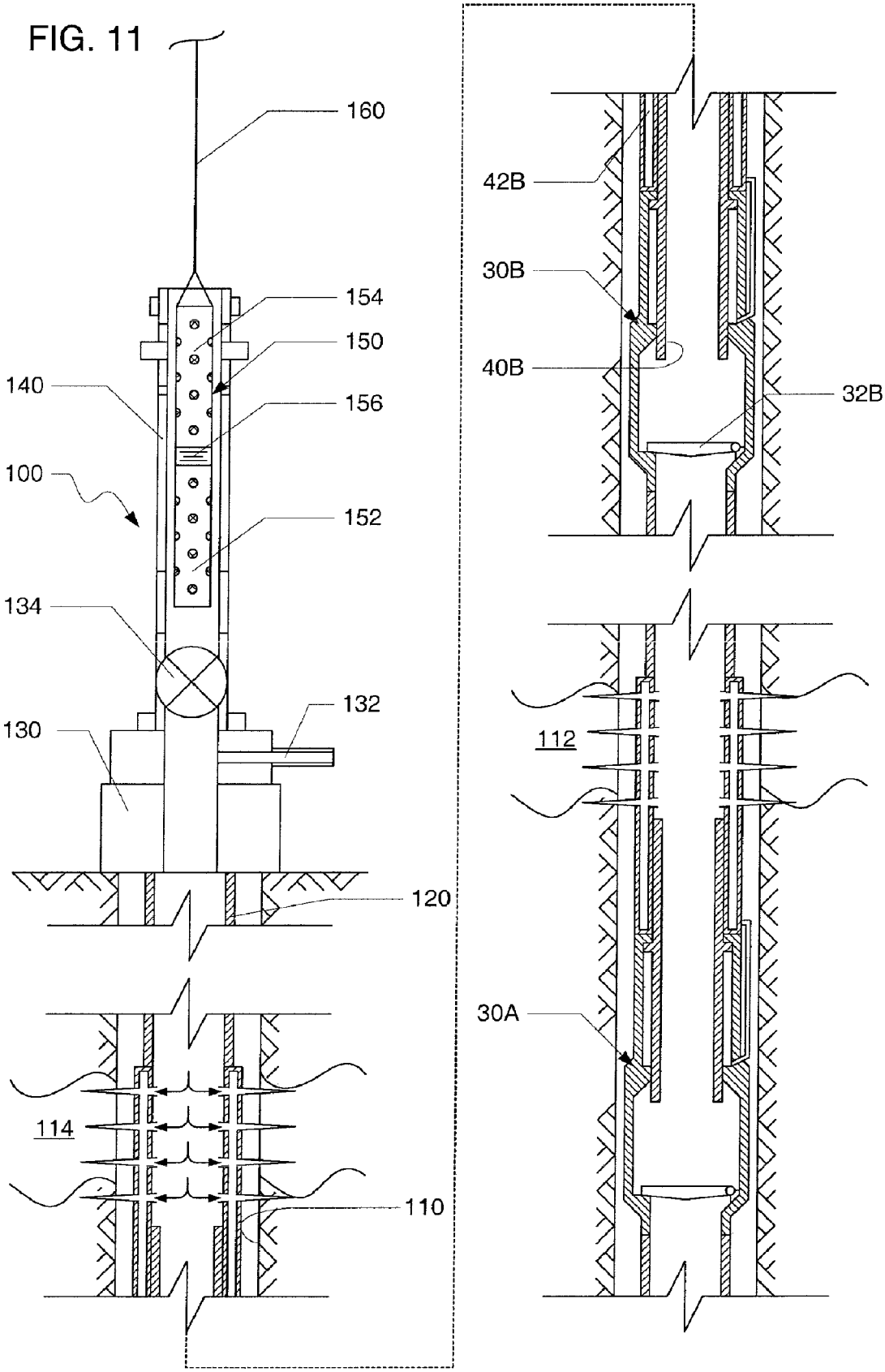

With respect to FIG. 11, once the well zone 114 is isolated, the perforating gun string 150 is pulled from the wellbore 110. A treatment fluid may then be injected into the perforated well zone 114 via the inlet conduit 132. Again, in some embodiments, the gun may remain in the lubricator 140, which is sealed off from the wellbore 110 by the inline valve 134.

In some embodiments, the well zones are selectively isolated and perforated starting from the bottom-most well zone and progressing uphole. In this way, each well zone is isolated from other downhole well zones by the zonal isolation valve and from other uphole well zones by the casing, which is not yet perforated for the uphole well zones.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for use in a wellbore having a plurality of well zones, comprising:

a casing deployed in the wellbore and suspended from a wellhead, the casing fixed to the wellbore by cement; and a plurality of valves connected to the casing, each valve adapted to isolate a selected well zone from at least one other well zone located downhole from the selected wellzone; the valve comprising:

a housing having an axial bore therein;

a flapper arranged within the housing, the flapper being moveable between an open position wherein communication via the axial bore of the housing is uninterrupted and a closed position wherein communication via the axial bore of the housing is interrupted; and an actuator for moving the flapper from the open position to the closed position, the actuator comprising an energy supplying device connected to the flapper to provide energy to move the flapper from the open position to the closed position, a sleeve arranged within the axial bore of the housing and adapted to engage the flapper and prevent the flapper from moving to the open position, a piston element formed on the sleeve and protruding radially outward, a sealed chamber arranged proximate the housing, the chamber having an internal pressure less than pressure of the wellbore, and a conduit connecting the chamber to the axial bore of the housing behind the piston element of the sleeve.

2. The system of claim 1, further comprising:

a perforating gun string suspended from a line, the perforating gun string moveable between a location within the wellbore adjacent to the chamber of a selected valve and a position outside the wellbore.

3. The system of claim 2, wherein the perforating gun string further comprises a plurality of guns, each gun adapted to rupture the chamber of a selected valve.

4. The system of claim 2, wherein the line is a wireline.

5. The system of claim 2, wherein the line is a slickline.

6. The system of claim 2, further comprising:

an inlet conduit connecting to the wellbore via the wellhead, the inlet conduit adapted to deliver a treatment fluid to a selected well zone;

a lubricator connected above the wellhead, the lubricator adapted to receive a gun string during treatment of the selected well zone; and an inline valve arranged between the lubricator and the wellbore, the inline valve adapted to interrupt communication from the wellbore to the lubricator during treatment of the selected well zone.

7. A valve for use in a wellbore having a plurality of well zones, comprising:

a housing having an axial bore therein;

a flapper arranged within the housing, the flapper being moveable between an open position wherein communication via the axial bore of the housing is uninterrupted and a closed position wherein communication via the axial bore of the housing is interrupted; and an actuator for moving: the flapper from the open position to the closed position, the actuator comprising: (i) an energy supplying device, connected to the flapper to provide sufficient energy to move the flapper from the open position to the closed position, (ii) a sleeve arranged within the axial bore of the housing, the sleeve adapted to engage the flapper and prevent the flapper from moving to the open position, (iii) a piston element formed on the sleeve and protruding radially outward, (iv) a sealed chamber arranged proximate the housing, the chamber having an internal pressure less than pressure of the wellbore, and (v) a conduit connecting the chamber to the axial bore of the housing behind the piston element of the sleeve.

8. The valve of claim 7, wherein the housing has a recess formed therein for receiving the flapper.

9. The valve of claim 7, wherein the sealed chamber is an annular chamber having an axial bore formed therethrough, the axial bore of the chamber being adapted to receive a perforating gun.

10. The valve of claim 9, wherein the sealed chamber is further adapted to receive one or more ruptures caused by ignition of the perforating gun, the one or more ruptures establishing communication between the wellbore and the chamber.

11. The valve of claim 10, wherein the axial bore of the housing has a shoulder formed therein, the shoulder adapted to engage the piston element on the sleeve and prevent the sleeve from moving upward to cover the one or more ruptures in the chamber.

12. The valve of claim 7, wherein the axial bore of the housing has a shoulder formed therein, the shoulder adapted to engage the piston element on the sleeve and prevent the sleeve from moving downward out of the axial bore of the housing.

13. The valve of claim 7, further comprising a shearable connector adapted to prevent the sleeve from moving downward out of the axial bore of the housing, the shearable connector further adapted to shear at a predetermined pressure.

14. A method for use in a wellbore having a plurality of well zones, comprising:

running a casing having a plurality of valves from a surface down into the wellbore such that each valve is proximate a well zone, wherein each valve is in an open position thereby facilitating hydraulic communication therethrough;

cementing the casing to the wellbore;

closing a selected valve by shifting a sleeve in the selected valve to release an energized flapper to interrupt communication between the surface and well zones below the selected valve, wherein shifting the sleeve includes running a perforating gun from the surface to a location adjacent to a sealed chamber in the selected valve, and detonating the perforating gun to rupture the sealed chamber and permitting wellbore fluid to enter the chamber and apply hydraulic pressure against the sleeve: and treating a well zone above the selected valve.

15. The method of claim 14, wherein the step of treating a well zone comprises:

raising the perforating gun to a location above the surface but within a tubular member, the tubular member being inline with the casing;

sealing the tubular member from the casing;

and delivering a treatment fluid from the surface to the wellzone above the selected valve.

16. The method of claim 15, wherein the tubular member is a lubricator.

17. A method for use in a wellbore having, a plurality of well zones, comprising the following steps:

(a) providing a casing string having at least a lower valve and an upper valve connected inline thereto;

(b) running the casing string from a surface down into the wellbore such that each valve is proximate a well zone, wherein each valve is in an open position thereby facilitating hydraulic communication therethrough;

(b) cementing the casing string to the wellbore;

(c) igniting a perforating gun to the well zone proximate the lower valve and to close the lower valve to interrupt communication between the surface and any well zones below the lower valve;

(d) treating the well zone proximate the lower valve; and (e) repeating step (c) for the upper valve.

* * * * *